US006478599B1

(12) United States Patent
McHugh et al.

(10) Patent No.: US 6,478,599 B1
(45) Date of Patent: Nov. 12, 2002

(54) CONTACT FOR CPU SOCKET

(75) Inventors: Robert G. McHugh, Golden, CO (US); Genn-Sheng Lee, Tu-Chen (TW); Hsiu-Yuan Hsu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,265

(22) Filed: Dec. 26, 2001

(51) Int. Cl.[7] ..... H01R 13/625
(52) U.S. Cl. ..... 439/342; 439/856; 439/857
(58) Field of Search ..... 439/342, 856, 439/857, 70, 525

(56) References Cited

U.S. PATENT DOCUMENTS 4,832,611 A * 5/1989 Noda et al. ..... 439/342
5,022,872 A * 6/1991 Shichida ..... 439/856
5,044,973 A * 9/1991 Noda et al. ..... 439/342

* cited by examiner

*Primary Examiner*—Tho D. Ta
(74) *Attorney, Agent, or Firm*—Wei Te Chung

(57) ABSTRACT

A contact (1) for a socket connector includes a base (20) and a pair of arm sections (30). The base has a contact pad (21) and a pair of body sections (22) upwardly extending from opposite ends of the contact pad. The pair of arm sections extend upwardly from upper sides of the pair of body sections. Each arm section comprises a planar clamp (31) at an upper end thereof and a palm (32) outwardly extending from a front end of the clamp.

3 Claims, 4 Drawing Sheets

CONTACT FOR CPU SOCKET

BACKGROUND OF THE INVENTION

1. Field of the Invention

The present invention generally relates to a contact for an electrical connector, and particularly to a U-shaped contact for a Central Processing Unit (CPU) socket connector.

2. Description of Related Art

U.S. Pat. No. 6,267,615 discloses a conventional contact for a CPU socket connector. As is shown in FIG. 3, the contact 5 comprises a base 50 and a pair of arm sections 60 connected to the base 50. The base 50 includes a body section 51, a head section 52 extending upwardly from the body section 51, and a soldering section 53 extending perpendicularly from a bottom edge of the body section 51. A pair of upper projections 521 and a pair of lower projections 511 are respectively formed on opposite lateral edges of a top portion of the head portion 52 and a bottom portion of the body section 51. The upper and lower projections 521, 511 interferentially secure the contact 5 in the CPU socket connector.

Each arm section 60 includes an upper arm 61 extending forwardly from opposite sides of the body section 51 to the soldering portion 53, an elbow 62 at a bottom portion of the upper arm 61, a forearm 63 extending upwardly from the elbow 62, a substantially planar clamp 64 at a top portion of the forearm 63, and a palm 65 extending from a distal end of the clamp 64 toward the body section 51. The two palms 65 and the body section 51 together define a free space 7 therebetween. The two clamps 64 define a clamping space 641 therebetween for clamping a pin 8 (shown in FIG. 4) of the CPU socket connector.

Referring to FIG. 4, the arm section 60 of the contact 5 is formed by a metal strip 60' at each side of a base strip 50' of a carrier strip. The pitch between two contacts 5' on the carrier strip is large, normally three times that of adjacent contact holes defined in the CPU socket connector. This adversely affects the efficiency of punching and assembling because one row of contact holes of the CPU socket connector must be filled up with contacts three times. Furthermore, the contact 5 will be distorted when the carrier strip is bended because the base 50 of the contact 5 connects with carrier strip directly.

SUMMARY OF THE INVENTION

An object of the present invention is to provide a contact which can be efficiently inserted into contact holes of a CPU socket connector.

Another object of the present invention is to provide a contact which can not be distorted when a carrier is bended.

To fulfill the above mentioned objects, a contact for a socket connector comprises a base and a pair of arm sections The base has a contact pad and a pair of body section upwardly extending from opposite ends of the contact pad. The pair of arm sections extend upwardly from upper sides of the pair of body sections. Each arm section comprises a planar clamp at an upper end and a palm outwardly extending from a front end of the clamp.

Other objects, advantages and novel features of the invention will become more apparent from the following detailed description of the present embodiment when taken in conjunction with the accompanying drawings.

DETAILED DESCRIPTION OF THE INVENTION

Figure 1:
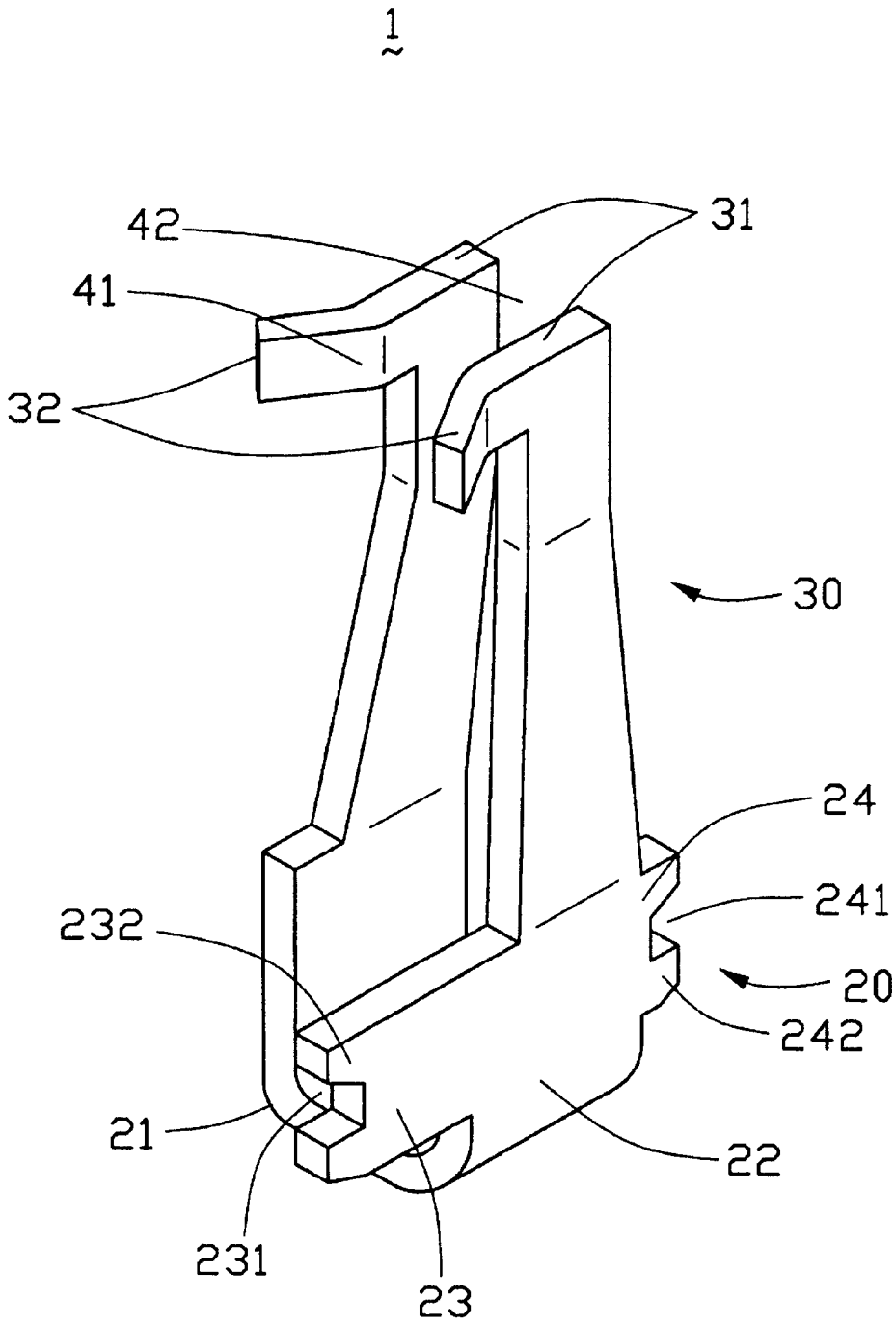
FIG. 1 is a perspective view of a contact in accordance with the present invention.
Figure 2:
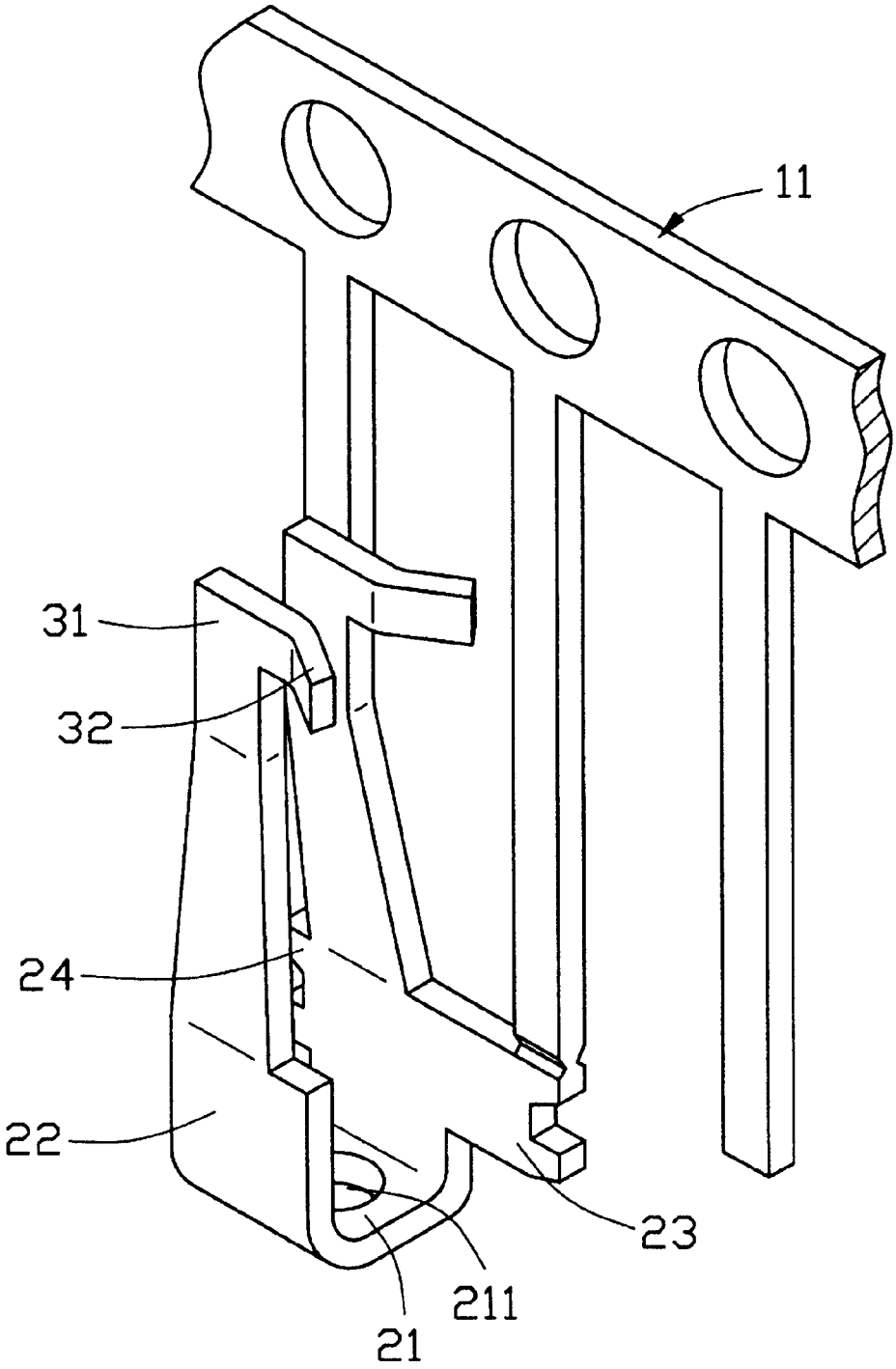
FIG. 2 is a plan view of the contact of FIG. 1 connected with a carrier.
Figure 3:
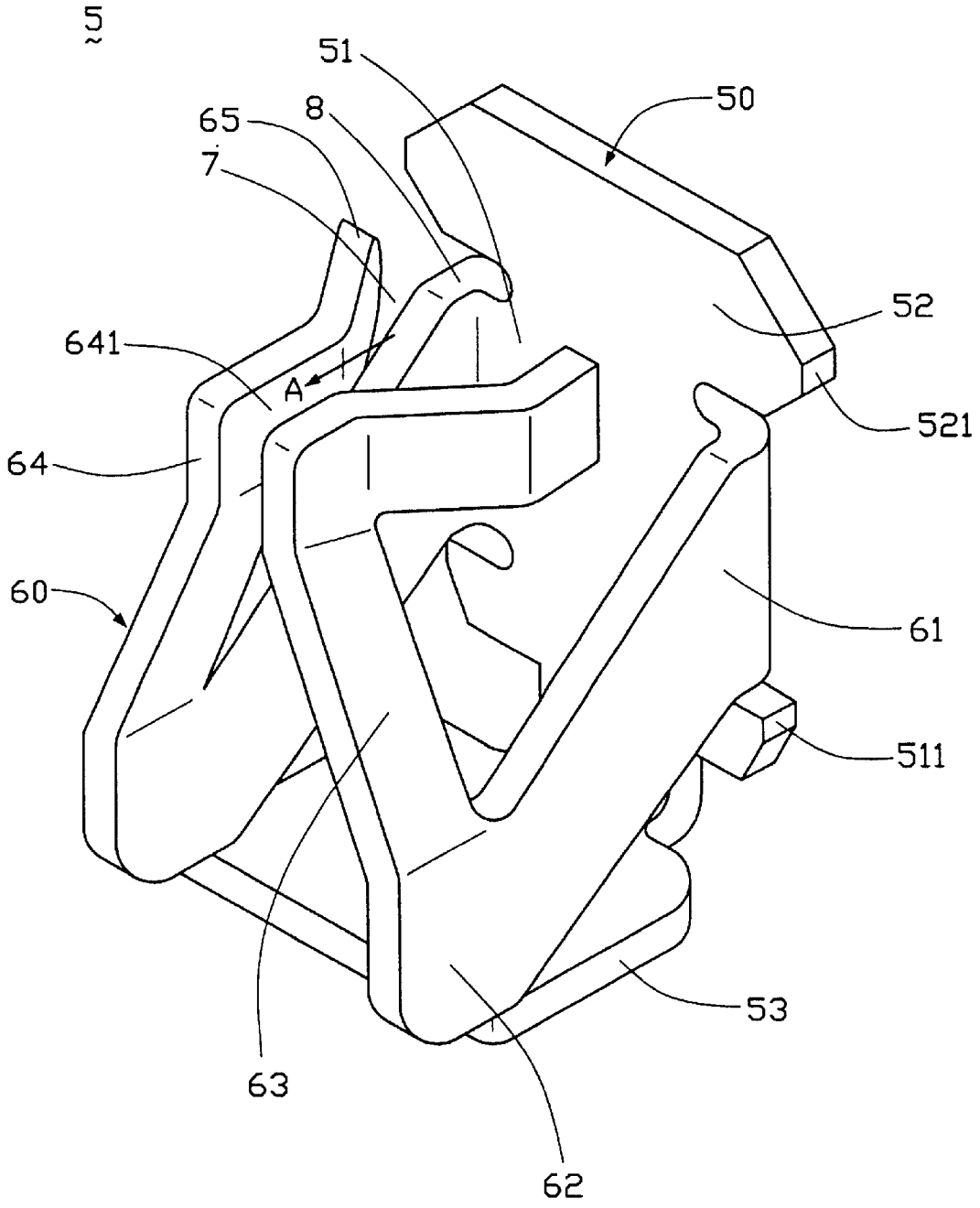
FIG. 3 (PRIOR ART)
FIG. 3 is a perspective view of a conventional contact.
Figure 4:
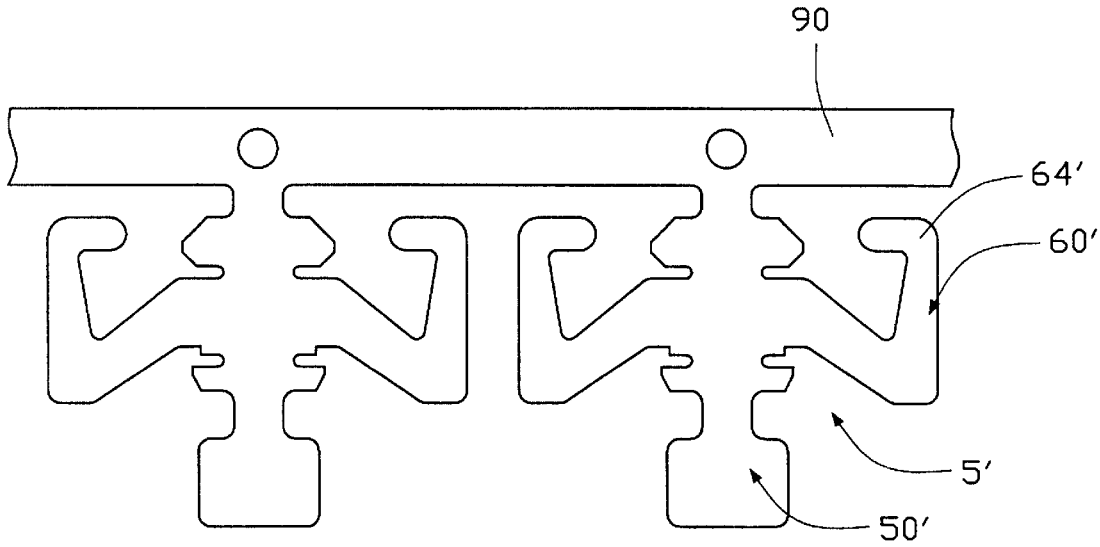
FIG. 4 (PRIOR ART)
FIG. 4 is plan view of two adjacent conventional contacts of FIG. 3 connected with a carrier.

Referring to FIGS. 1 and 2, a contact 1 for a CPU socket connector (not shown) in accordance with the present invention comprises a base 20 and a pair of arm sections 30 formed on opposite sides of the base 20.

The base 20 is U-shaped and comprises a contact pad 21, a pair of body section 22 upwardly extending from opposite ends of the contact pad 21. The contact pad 21 forms a hole 21 in a center for securely attached a solder ball (not shown) thereon. One of the body section 22 has a longer projection 23 and a shorter projection 24 formed on opposite lateral sides thereof respectively. The projections 23, 24 define recesses 231, 241 at the end portion and form pairs of barbs 232, 242 at the opposite sides of the recesses 231, 241.

The arm sections 30 extend upwardly from upper sides of the pair of body sections 22. Each arm section 30 comprises a planar clamp 31 at an upper end thereof and a palm 32 outwardly extending from a front end of the clamp 31. The palms 32 define a free space 41 and the two clamps 31 define a clamping space 42 therebetween.

Referring to FIG. 2, the pitch between two adjacent contacts 1 in accordance with the present invention is small on a carrier 11 due to the configuration of the contact 1. This improves efficiency of punching, gilding, and assembling of the contacts 1. The contact 1 has only a long projection 23 connected with the carrier 11, so it will not be distorted when the carrier 11 is bended.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact for a socket connector, comprising:

a U-shaped base having a horizontal contact pad for soldering to a printed circuit board and a pair of body sections upwardly extending from opposite ends of the contact pad; and a pair of arm sections extending upwardly from upper sides of the pair of body sections, each arm section comprising a planar clamp at an upper end thereof and a palm outwardly extending from a front end of the clamp;

wherein one of the body sections has a first protection and a second projection shorter than the first projection on opposite lateral sides thereof respectively, each projection defining a recess at an end portion thereof and forming a pair of barbs at two sides of the recess;

wherein the contact pad forms a hole in a center thereof.

2. The contact as described in claim 1, wherein the pair of palms define a free space therebetween and the pair of clamps define a clamping space therebetween.

3. A contact for use with a CPU pin, comprising:

a U-shaped base including a horizontal contact pad for soldering to a printed circuit board with a pair of body sections upwardly extending from opposite ends thereof;

barbs formed on two sides of one of said pair of body sections for retaining said contact in a housing of a connector which the CPU pin is coupled to;

a pair of arm sections upwardly respectively extending from upper edges of said pair of body sections with a pair of clamps at upper portions thereof, respectively;

a pair of palms respectively extending from said pair of clamps generally horizontally toward a same side of one of said barbs while also outwardly away from each other;

wherein said contact pad defines a hole therein.

* * * * *